US008042607B2

(12) United States Patent
Pfitzer et al.

(10) Patent No.: US 8,042,607 B2
(45) Date of Patent: Oct. 25, 2011

(54) CONDUCTING DEVICE INCLUDING A CORRUGATED FIN FOR A HEAT EXCHANGER

(75) Inventors: Matthias Pfitzer, Deizisau (DE); Ingo Trautwein, Bietigheim-Bissingen (DE)

(73) Assignee: Behr GmbH & Co. KG, Stuttgart (DE)

( * ) Notice: Subject to any disclaimer, the term of this patent is extended or adjusted under 35 U.S.C. 154(b) by 102 days.

(21) Appl. No.: 12/278,806

(22) PCT Filed: Feb. 12, 2007

(86) PCT No.: PCT/EP2007/001173

§ 371 (c)(1), (2), (4) Date: Aug. 8, 2008

(87) PCT Pub. No.: WO2007/093338

PCT Pub. Date: Aug. 23, 2007

(65) Prior Publication Data

US 2009/0038786 A1 Feb. 12, 2009

(30) Foreign Application Priority Data

Feb. 13, 2006 (DE) ..... 10 2006 006 770

(51) Int. Cl.
*F28F 13/18* (2006.01)
*F28F 19/02* (2006.01)

(52) U.S. Cl. ..... 165/133; 165/905

(58) Field of Classification Search ..... 165/133, 165/905

See application file for complete search history.

(56) References Cited

U.S. PATENT DOCUMENTS

| | | | | |
|---|---|---|---|---|
| 4,093,755 | A * | 6/1978 | Dahl et al. | 427/451 |
| 4,211,276 | A | 7/1980 | Itoh et al. | |
| 4,258,783 | A * | 3/1981 | Albertson et al. | 165/133 |
| 4,317,484 | A * | 3/1982 | Tanabe et al. | 165/134.1 |
| 4,354,550 | A * | 10/1982 | Modahl et al. | 165/133 |
| 4,359,086 | A | 11/1982 | Sanborn et al. | |
| 4,421,789 | A * | 12/1983 | Kaneko et al. | 427/204 |
| 4,852,791 | A * | 8/1989 | Otsuka et al. | 228/183 |
| 5,366,004 | A * | 11/1994 | Garner et al. | 165/133 |
| 5,377,746 | A | 1/1995 | Reid et al. | |
| 5,732,767 | A * | 3/1998 | Saperstein | 165/133 |
| 5,800,673 | A * | 9/1998 | Okuda et al. | 159/28.6 |
| 6,568,465 | B1 | 5/2003 | Meissner et al. | |
| 6,571,864 | B1 | 6/2003 | Yoon et al. | |
| 2002/0074110 | A1 | 6/2002 | Otter | |
| 2003/0039856 | A1 | 2/2003 | Gillispie et al. | |
| 2006/0196644 | A1 | 9/2006 | Boger et al. | |

FOREIGN PATENT DOCUMENTS

| | | | |
|---|---|---|---|
| DE | 201 19 741 | U1 | 8/2002 |
| DE | 10 2004 011 544 | A1 | 10/2004 |
| EP | 0 053 452 | B1 | 6/1982 |
| GB | 2 401 582 | A | 11/2004 |
| WO | WO 2005/019739 | A1 | 3/2005 |

* cited by examiner

*Primary Examiner* — Ljiljana Ciric
(74) *Attorney, Agent, or Firm* — Foley & Lardner LLP

(57) ABSTRACT

A conducting device, such as a corrugated fin, for a heat exchanger, has at least one surface with an increased microscopic roughness. A method increases the microscopic roughness of at least one surface of a conducting device such as a corrugated fin. A heat exchanger, such as an evaporator for an air-conditioning system of a motor vehicle, has tubes through which a medium flows and between which conducting devices are arranged, the conducting devices having a further medium, such as moist air, flowing around them.

10 Claims, No Drawings

CONDUCTING DEVICE INCLUDING A CORRUGATED FIN FOR A HEAT EXCHANGER

The invention relates to a conducting device, in particular a corrugated fin, for a heat exchanger, with at least one surface. The invention also relates to a method for increasing the roughness, in particular the microscopic roughness, of the surface of a conducting device of this type. The invention furthermore relates to a heat exchanger, in particular an evaporator for an air-conditioning system of a motor vehicle, with tubes through which a medium flows and between which conducting devices are arranged, said conducting devices having a further medium, in particular moist air, flowing around them.

The heat transfer capacity of evaporators in motor vehicles is determined, inter alia, by the condensation of the air moisture on the evaporator surface. In order to obtain an optimum transfer of heat, the condensed water on the evaporator surface should not form any drops, but rather must drain off as a uniform film. German utility model DE 201 19 741 U1 discloses a heat transfer surface on tubular or plate-like bodies with a microstructure, which projects out of the basic surface, of projections which are galvanized onto the basic surface at a minimum height of 10 μm. The basic surface is entirely or partially covered by projections. The projections are applied in the form of orderly microstructures and are in the shape of pins. German laid-open specification DE 102 39 071 A1 discloses a method for producing surfaces on which liquids do not adhere. The known surface has a multiplicity of depressions or elevations.

It is the object of the invention to improve the efficiency of heat exchangers, in particular of evaporators.

The object is achieved in the case of a conducting device, in particular a corrugated fin, for a heat exchanger, with at least one surface, in that the surface of the conducting device has an increased roughness, in particular microscopic roughness. By means of the specific increase in the roughness on the surface of the conducting device, the condensation of moisture on the surface of the conducting device is evened out and the drainage of water improved. As a result, the transfer capacity of a heat exchanger equipped with the conducting device can be increased.

A preferred exemplary embodiment of the conducting device is characterized in that particles which have a size from 10 to 80 μm are arranged on the surface of the conducting device. The particles are preferably of platelet-like, globular or needle-like design.

A further preferred exemplary embodiment of the conducting device is characterized in that the particles or some of the particles are formed from a metallic material. The particles are preferably formed from the same material or a similar material as the conducting device. As a result, the production and the recycling of a heat exchanger equipped with the conducting device are facilitated.

A further preferred exemplary embodiment of the conducting device is characterized in that the particles or some of the particles are formed from pure aluminum. Within the context of the present invention, good results have been obtained with pure aluminum.

A further preferred exemplary embodiment of the conducting device is characterized in that the particles or some of the particles are formed from a non-metallic material. The non-metallic material preferably has hydrophilic properties.

A further preferred exemplary embodiment of the conducting device is characterized in that the non-metallic material is selected from the group comprising oxides, nitrides, carbides and borides of the elements of the third, fourth and fifth transition group and of the third and fourth main group of the periodic table of the elements.

A further preferred exemplary embodiment of the conducting device is characterized in that the particles or some of the particles are formed from titanium dioxide ($TiO_2$). Within the context of the present invention, good results have been obtained with titanium dioxide.

In the case of a method for increasing the roughness, in particular the microscopic roughness, of at least one surface of a conducting device, in particular a corrugated fin, for a heat exchanger, the previously stated object is achieved in that particles are added to a flux, said particles being applied together with the flux to the surface of the conducting device or of a semi-finished conducting device. The flux is preferably a flux based on a potassium fluoroaluminate with the total formula $K_{1-3}AlF_{4-6}$. Use is preferably made of a flux which is sold under the name Nocolok® by Solvay.

A preferred exemplary embodiment of the method is characterized in that the flux is applied together with the particles in the form of a suspension to the surface of the conducting device or of a semi-finished conducting device. The preferably aqueous suspension contains a binding agent. The binding agent ensures, inter alia, that the particles adhere to the surface of the conducting device or of the semi-finished conducting device.

A further preferred exemplary embodiment of the method is characterized in that the flux is applied together with the particles to a corrugated fin strip. The application can take place before or after punching of the corrugated fin strip. The corrugated fin strip is preferably in the form of "coils". The application method is therefore also referred to as coil coating.

A further preferred exemplary embodiment of the method is characterized in that the flux is applied together with the particles by spraying or dip-coating onto the surface of the conducting device or of a semi-finished conducting device. These application methods have proven advantageous in the context of the present invention.

Further preferred exemplary embodiments of the method are characterized in that the surface is roughened by slight chemical etching and/or by mechanical machining, such as brushing, grinding or abrasive-blasting.

A further preferred exemplary embodiment of the method is characterized in that the particles are applied to the surface of the conducting device by thermal metal spraying. The metal particles which are sprayed on are preferably formed from aluminum or an aluminum alloy.

The invention also relates to a heat exchanger, in particular an evaporator for an air-conditioning system of a motor vehicle, with tubes through which a medium flows and between which previously described conducting devices are arranged, said conducting devices having a further medium, in particular moist air, flowing around them. The roughness of the surfaces of the conducting devices has preferably been increased by a previously described method.

Further advantages, features and details of the invention emerge from the description below in which various exemplary embodiments are described in detail. The features mentioned in the claims and in the description may in each case be essential here to the invention individually by themselves or in any desired combination.

The invention relates in particular to evaporators of motor vehicle air-conditioning systems. An evaporator of this type is arranged, for example, in the passenger compartment of the motor vehicle. A fan sucks up air from the outside or in the passenger compartment and delivers it via the evaporator. In the process, the air is cooled and excess air moisture present is precipitated. The condensation water is collected below the evaporator and conducted away to the outside via a conduit. The evaporator comprises a multiplicity of tubes through which refrigerant flows. Conducting devices, in particular corrugated fins, are arranged between the tubes and have the moist air flowing around them.

The conducting device is a corrugated fin which is present in the form of a corrugated fin strip on a "coil". According to an essential aspect of the present invention, the microscopic roughness of the corrugated fin is increased in a specific manner. The microscopic roughness of the corrugated fin can be increased before or after punching of the corrugated fin.

The corrugated fin is coated with a flux. The flux is a flux based on potassium fluoroaluminate with the total formula $K_{1-3}AlF_{4-6}$. Such a flux is sold under the name Nocolok® by Solvay.

According to one embodiment of the invention, metallic particles are added to the flux. The metallic particles are formed from pure aluminum and have a grain size of between 10 and 80 μm.

According to a further embodiment of the invention, non-metallic particles with a grain size of between 10 and 80 μm are added to the flux. The non-metallic particles are preferably formed from titanium dioxide ($TiO_2$).

According to a further embodiment of the invention, the particles are applied by thermal spraying of metals. Aluminum or aluminum alloys is or are used as the spraying material. The method parameters in the case of metal spraying are selected in such a manner that the metal particles produced are of a size of between 10 and 80 μm.

The flux together with the metallic or non-metallic additives is preferably applied by means of coil coating. As an alternative, the suspension containing the flux and the additives can also be applied by spraying or dip-coating.

According to a further embodiment of the invention, the surface of the corrugated fins is roughened by slight chemical etching. As an alternative or in addition, the corrugated fin surface can also be mechanically roughened by brushing, grinding or abrasive-blasting. It is also possible to subsequently coat the corrugated fin surface with organic polymers to which metallic or non-metallic particles are added.

The addition of the particles to the flux has the advantage that the modification of the corrugated fin surface in order to increase the microscopic roughness can take place in-line during a soldering process, without additional re-coating. The heat transfer between the heat exchanger surface and the air is improved by increasing the microscopic roughness. As a result, the transfer capacity of the heat exchanger can be increased. The condensation of moisture on the corrugated fin is significantly improved by increasing the microscopic roughness of the corrugated fin surface. Furthermore, the water drainage of an evaporator equipped with the corrugated fins according to the invention is improved. As a result, the overall size of the evaporators can be reduced while maintaining the same heat transfer capacity. As an alternative, the heat transfer capacity can be increased while maintaining the same overall size.

The invention claimed is:

1. An evaporator with a conducting device comprising a corrugated fin including at least one surface, the at least one surface of the corrugated fin having an increased microscopic roughness, wherein particles which have a size of from 10 to 80 μm are arranged on the surface of the evaporator, wherein said particles are added to a flux, and wherein the flux is applied together with the particles in the form of a suspension to the surface of the evaporator while the flux is applied together with the particles to the corrugated fin, or wherein the flux is applied together with the particles by spraying or dip-coating onto the surface of the conducting device.

2. The evaporator as claimed in claim 1, wherein at least some of the particles are formed from a metallic material.

3. The evaporator as claimed in claim 2, wherein at least some of the particles are formed from pure aluminum.

4. The evaporator as claimed in claim 1, wherein at least some of the particles are formed from a non-metallic material.

5. The evaporator as claimed in claim 4, wherein the non-metallic material is selected from the group consisting of oxides, nitrides, carbides and borides of the elements of the third, fourth and fifth transition groups and of the third and fourth main groups of the periodic table of the elements.

6. The evaporator as claimed in claim 1, wherein at least some of the particles are formed from titanium dioxide ($TiO_2$).

7. A method for increasing a microscopic roughness of at least one surface of a conducting device comprising a corrugated fin of an evaporator, the method comprising:

arranging particles which have a size of from 10 to 80 μm on the surface of the evaporator, wherein said particles are added to a flux, wherein the flux is applied together with the particles in the form of a suspension to the surface of the evaporator while the flux is applied together with the particles to the corrugated fin, or wherein the flux is applied together with the particles by spraying or dip-coating onto the at least one surface of the conducting device, and wherein the surface is roughened by chemical etching.

8. A method for increasing a microscopic roughness of at least one surface of a conducting device comprising a corrugated fin of an evaporator, the method comprising:

arranging particles which have a size of from 10 to 80 μm on the surface of the evaporator, wherein said particles are added to a flux, wherein the flux is applied together with the particles in the form of a suspension to the surface of the evaporator while the flux is applied together with the particles to the corrugated fin, or wherein the flux is applied together with the particles by spraying or dip-coating onto the surface of the evaporator, and wherein the surface is roughened by mechanical machining.

9. A method for increasing a microscopic roughness of at least one surface of a conducting device comprising a corrugated fin of an evaporator, the method comprising:

arranging particles which have a size of from 10 to 80 μm on the surface of the evaporator, wherein said particles are added to a flux, wherein the flux is applied together with the particles in the form of a suspension to the surface of the evaporator while the flux is applied together with the particles to the corrugated fin, or wherein the flux is applied together with the particles by spraying or dip-coating onto the surface of the evaporator, and wherein the particles are applied to the at least one surface of the conducting device by thermal metal spraying.

10. An evaporator for an air-conditioning system of a motor vehicle, with tubes through which a medium flows and between which conducting devices are arranged, said conducting devices having moist air as an additional medium flowing around them, said conducting devices comprising corrugated fins with at least one surface, wherein the at least one surface of the corrugated fins has an increased microscopic roughness, wherein particles which have a size of from 10 to 80 μm are arranged on the surface of the evaporator, wherein said particles are added to a flux, wherein the flux is applied together with the particles in the form of a suspension to the surface of the evaporator while the flux is applied together with the particles to the corrugated fin, or wherein the flux is applied together with the particles by spraying or dip-coating onto the surface of the conducting device.

* * * * *